United States Patent [19]

Molitor

[11] Patent Number: 4,753,616

[45] Date of Patent: Jun. 28, 1988

[54] CONTACT ELEMENT FOR AN ELECTRICAL PLUG CONNECTOR

[75] Inventor: Paul-Rainer Molitor, Mühldorf/Inn, Fed. Rep. of Germany

[73] Assignee: Otto Dunkel GmbH, Fabrik fur Elektrotechnische Gerate, Muhldorf/Inn, Fed. Rep. of Germany

[21] Appl. No.: 47,104

[22] Filed: May 8, 1987

[30] Foreign Application Priority Data

May 12, 1986 [DE] Fed. Rep. of Germany ..... 3615915

[51] Int. Cl.[4] ..... H01R 11/09

[52] U.S. Cl. ..... 439/787; 439/825; 439/843; 439/851

[58] Field of Search ..... 439/884, 885, 891, 786, 439/787, 816, 825, 826, 827, 834, 839, 842, 843, 847, 851, 852, 856, 857, 858, 861, 862, 796, 833, 821

[56] References Cited

U.S. PATENT DOCUMENTS

| | | | |
|---|---|---|---|
| 3,086,190 | 4/1963 | Neidecker et al. | 439/787 |
| 3,470,527 | 9/1969 | Bonhomme | 339/256 |
| 3,976,903 | 8/1976 | Cotton | 439/13 |
| 4,203,647 | 5/1980 | Bonhomme | 439/851 |
| 4,572,606 | 2/1986 | Neumann et al. | 439/843 |
| 4,662,706 | 5/1987 | Foley | 439/851 |

FOREIGN PATENT DOCUMENTS

| | | | |
|---|---|---|---|
| 0092471 | 10/1983 | European Pat. Off. | 439/851 |
| 1590124 | 7/1966 | Fed. Rep. of Germany . | |
| 2558003 | 6/1977 | Fed. Rep. of Germany . | |
| 1388666 | 1/1965 | France | 439/851 |
| 1288757 | 9/1972 | United Kingdom | 439/851 |

*Primary Examiner*—David Pirlot

*Attorney, Agent, or Firm*—Holman & Stern

[57] ABSTRACT

The contact element for an electrical plug connector has a plurality of contact springs disposed side by side, each such spring being a segment of a contact spring wire, one end of which is attached to a bearing piece. Each such spring has, in its middle region, a contact locus which provides contact with a cooperating contact piece. In order to substantially simplify the structure from a manufacturing engineering standpoint, a single structural unit is formed from a first metal strip which forms the bearing piece, a plurality of spacing members connected to the bearing piece and extending parallel to each other, and a second metal strip parallel to the first, which second strip forms the support piece. In the neighborhood of the bearing piece and support piece, the spacing members undergo a bending away from the common plane of the bearing piece and the support piece and toward the front side of the contact element, such that the middle extent of the spacing members is disposed such that any two given successive spacing members laterally define a flat chamber. In this chamber a plurality of parallel contact springs are disposed side by side.

16 Claims, 1 Drawing Sheet

CONTACT ELEMENT FOR AN ELECTRICAL PLUG CONNECTOR

BACKGROUND OF THE INVENTION

The present invention relates to a contact element for an electrical plug connector.

In a known contact socket element of this type which can be manufactured by automatic means (West German Pat. No. 15 90 124), the bearing piece which bears the contact springs is comprised of a sleeve, and the contact springs extend at an angle to the axis of the sleeve and have bent-around ends which are attached to the edge of the sleeve. Since the contact springs have a configuration including an element corresponding to a set of generatrices of a hyperboloid of revolution, they have the minimum mutual transverse separation in approximately their middle region, considered in an axial cross section through the sleeve with the contact springs mounted on it. Accordingly, these are the locations of the contact loci where the contact pin or plug comes into electrically conducting contact with the contact springs.

It has proven to be disadvantageous with these known contact spring sockets that one must have a relatively large sleeve to mount the contact springs and hold them in place, in which sleeve only a few contact springs can be inserted, sequentially, followed by the relatively costly effort of attachment of their end faces. These problems are particularly acute in the case where one attempts miniaturization of contact spring sockets, having diameters less than 1 mm.

In a contact element in the form of a contact spring socket or spring-loaded pin or plug, according to an older unpublished West German Patent Application No. P 36 08 276.7, the contact springs are connected by metallic conducting means on one of their ends to form a mat-like contact spring unit, the springs running mutually perpendicularly, and are given a radially curved configuration, following which this unit is rolled into a cylindrical shape which enables attachment to a separate support piece. This eliminates the problem arising in the manufacture of previously known contact elements as seen in West German Pat. No. 25 58 003 wherein a mat-like contact spring unit has contact spring wire bent into a wave shape, wherein the contact spring wire segments, which run parallel to each other, are interconnected by arcuate conductor segments. Because in practice there is a minimum practicable radius of curvature for the curved connecting segments, there is in practice a minimum mutual separation distance of the contact spring wire segments. Further, it has been found difficult to manipulate the contact spring mat of the type described in West German Pat. No. 25 58 003 because of its inherent flexibility and its elasticity. In particular, distortion results from the fact that the arcuate segments resist bending around an axis parallel to the contact spring wire segments.

The underlying problem of the present invention is to devise a contact element of the type referred to initially supra, which element has a relatively simple structure, can be inexpensively manufactured, and is of compact size, preferably for use with plug connectors, yet has high current carrying capacity and low required plug insertion forces.

SUMMARY OF THE INVENTION

The present inventive contact spring socket solves the foregoing problems and can be manufactured from wire-like metal strips to form the bearing piece and support piece, and wire-like material can also be employed to form the spacing members which are formed and combined to create flat open rectangular regions referred to hereinafter as flat chambers. It is particularly advantageous if the two said metal strips and the spacing members are together stamped as a single structural unit from a sheet of contact metal.

It is advantageous to employ two metal strips of very thin sheet metal, joined by formed spacing members, such that the two thin metal strips serve as the bearing piece and support piece, respectively. As a result, a relatively simple, convenient, completely automatic means can be used to apply and affix the contact springs while the strips are still in a flat configuration. The contact element having the characteristic inventive structure forms the critical component in manufacturing linear or cylindrical contact sockets and plugs, wherein the contact is established and maintained without significant problems and with minimal contact resistance, while at the same time the required plug insertion force is relatively low. The inventive contact element is particularly suitable for multiple plug connectors.

It has proven advantageous in applications of contact elements to form a contact spring plug or a contact spring socket if the two metal strips forming the bearing piece and support piece, respectively, are bent into an essentially cylindrical shape around an axis perpendicular to the longitudinal direction of extent of the respective metal strips and at a predetermined distance from them. By simple bending about the axis, the contact element can then be given the desired cylindrical (plug or socket) form. The substantial advantage afforded is that a socket body or a plug body can be used in conjunction with a unit comprised of the bearing piece and support piece, to which unit the contact springs are attached, such that the diameter of the body is adjusted to the diameter in the cylindrical contact pin structure or contact socket structure of the spacing members which are bent outward from the level of the support piece and bearing piece, after the unit comprised of the support piece and bearing piece has been bent into a cylindrical shape. A further advantage is that the cylindrical contact pin structure or contact socket structure can be pushed, respectively, into the socket body or onto the plug body, with elastic deformation of the spacing members. In this way, particularly good passage of current from the contact springs to the socket body is ensured.

In one embodiment, it has been found particularly advantageous if the contact springs are radially curved toward the rear out of the plane of the original flat strips, in their middle region between the bearing piece and the support piece, in order to provide good contact.

This curvature may be dispensed with if the contact springs are disposed at an angle to the longitudinal extent of the bearing piece and support piece, said angular disposition being in the middle region of the contact springs between the bearing piece and support piece, and if the associated spacing members are disposed so as to be generally parallel to said contact springs. Here the disposition of the contact springs ensures that when the metal strips forming the bearing piece and support piece are bent into the cylindrical shape, the contact springs assume a position corresponding to that in the known contact spring sockets mentioned supra wherein compact sleeves are started with for affixing the contact springs to. In this connection, it is advantageous if the contact springs are firmly joined not only to the bearing piece but also to the support piece. With this embodiment the spring force depends on the size and number of the spacing members between the bearing piece and support piece, because these determine the distance between the support pieces which hold the ends of the contact springs.

In forming contact spring sockets, it has been found advantageous if the axis, around which the two metal bearing strips for forming a contact socket structure are bent, is facing the rear side of the contact element; and if the contact socket structure is provided with a socket body which houses it, such that the spacing members abut the socket body. This socket body may be comprised of a cylindrical sleeve formed from sheet metal, with the contact socket structure being capable of being pushed into said sleeve. With this embodiment, an additional radial structure may optionally be provided on the socket body, for attaching of the contact socket structure thereto.

In another embodiment, a socket body in the form of a turned cylinder is used to house the contact socket structure.

The features of the present invention also provide in another embodiment an advantageous means of broadening the range of possible applications of the inventive contact element to encompass the manufacture of double sockets.

The inventive contact element can also be advantageously used in forming spring-loaded plugs wherein an axis, around which the two metal bearing strips are bent to form a contact plug structure, is facing the front side of the contact element, and wherein the contact plug structure is provided with a plug body on which it is mounted and against which the spacing members abut. Here too, with a socket structure, the spacing members which elastically abut the exterior side of the plug body provide for relatively problem-free passage of current from the contact element to the plug body.

In the manufacture of cylindrical contact spring sockets or of spring-loaded plugs, it has proven advantageous if the socket body or plug body has a radially directed guide edge which extends over or in front of the cylindrically formed support piece against which piece the free ends of the contact springs abut.

In the formation of a contact spring from flat, elongated members, with the aid of the inventive contact element, a socket housing is advantageously employed which has a flat recess into which the two metal strips with the spacing members and the radially curved contact springs are inserted, with the metal strip forming the bearing piece being inserted first, and to which housing said metal strips are affixed, such that the spacing members abut one of the two flat walls of said recess, the contact springs extending out into the recess, and the metal strip which forms the support piece being disposed near the external opening of the recess.

In order to ensure that the free ends of the contact springs are not contacted on their end faces by, and damaged by, the opposite contact when the latter is inserted into the contact spring socket or over the contact spring plug, it has proven advantageous to provide the metal strip forming the support piece with an extension edge which extends in the plane of the main extent of the spacing members.

Additional details, advantages, and features of the present invention will be seen from the following description and from the drawings. Express reference to the drawings is made herein for the purpose of formal disclosure of all details not described in the text.

DETAILED DESCRIPTION OF THE INVENTION

Figures 1, 2, 3, 4, 5, 6, 7, 8:
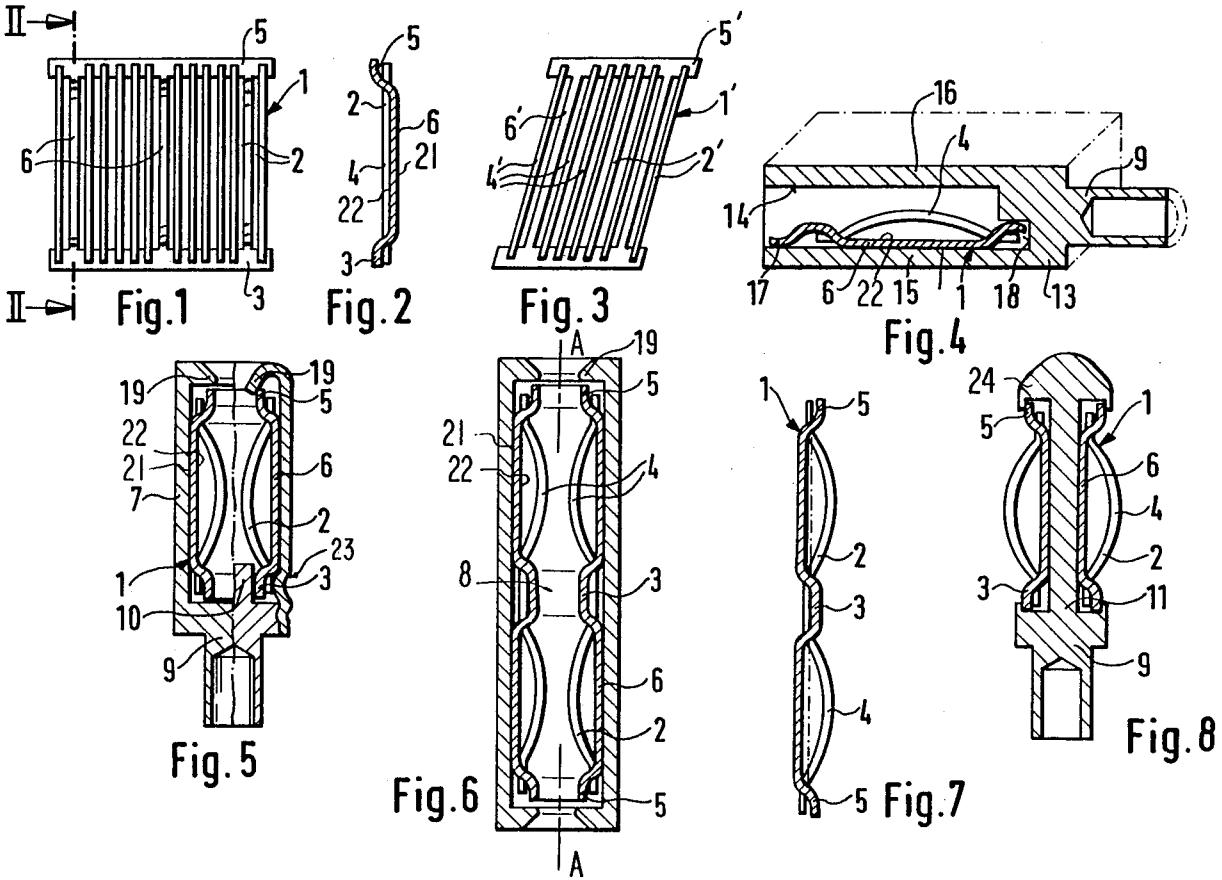
FIG. 1 is a plan view of a segment of a contact element.
FIG. 2 is a cross sectional view through line II—II of the contact element of FIG. 1.
FIG. 3 is a plan view of a variant embodiment of the contact element of FIG. 1.
FIG. 4 is a longitudinal cross section through a linear contact spring socket containing the illustrated contact element.
FIG. 5 is a longitudinal cross sectional view of two variant embodiments of a contact spring socket containing the illustrated contact element.
FIG. 6 is a longitudinal cross section through a double contact spring socket.
FIG. 7 is a cross section through a contact element used in the double contact spring socket of FIG. 6.
FIG. 8 is a longitudinal cross section through a plug which employs the illustrated contact element.

It is seen from the drawings that the contact element 1 for electrical plug connectors comprises a plurality of contact springs 2 disposed side by side, each such spring being a segment of a contact spring wire, one end of each segment (the lower end in FIG. 1) being attached to a bearing piece 3 by means of soldering or welding, preferably by laser welding. In a middle region 4, the springs 2 have a contact locus which provides contact with a cooperating contact piece (not shown), which contact locus will be described further infra. Parallel to the bearing piece 3 formed by a first metal strip is a support piece 5 formed by a second metal strip at a predetermined distance from the first. Support piece 5 and bearing piece 3 are connected as a structural unit by spacing members 6. The unit comprised of the metal strips 3 and 5 and the spacing members 6 is preferably formed by being stamped out of a sheet of contact metal.

As seen from FIG. 2, the spacing members 6 are bent forward (upward, from the plane of FIG. 1) out of the plane of the bearing piece 3 and support piece 5, said bending occurring in the neighborhood of strips 3 and 5. The spacing members 6 are configured such that any two successive spacing members 6 laterally delimit a region therebetween along the strips 3, 5, this region being referred to hereafter as a flat chamber. In each of the exemplary embodiments illustrated in FIGS. 1 and 3, groups of five contact springs 2 are disposed side by side in a planar disposition between any two adjacent pairs of spacing members 6, which springs are perpendicular to the longitudinal extent of bearing piece 3 and support piece 5. This perpendicularity is retained even if the contact springs 2 are given a radial curvature (by any known process, such as stamping) toward the rear, in their middle regions 4 (between the bearing piece 3 and the support piece 5), as seen in FIG. 4. The terms "front" and "rear" as used herein refer to directions taken from FIG. 1.

As illustrated in FIGS. 5 to 8, the two metal strips which form the bearing piece 3 and the support piece 5 are bent into an essentially cylindrical shape, about an axis running perpendicular thereto and at a predetermined radial distance therefrom. In the case of FIGS. 5–7, the axis A—A about which the two metal strips 3,5 are bent is facing the rear side 22 (as viewed originally in FIGS. 1 and 2) of the bearing piece 3 and support piece 5, so that a cylindrical contact socket is formed from the original contact element. The bending axis coincides with the axis A—A of the contact socket. In the contact sockets of FIGS. 5 and 6, a generally cylindrical socket body 7 is provided which contains the contact element. The spacing members 6 are braced against the body 7.

In the embodiment illustrated on the right half of FIG. 5, the socket body 7 is comprised of a sleeve formed into a cylindrical shape from a sheet of metal. The contact socket structure formed by a cylindrically bent segment of the contact element 1 can be pushed into the body 7. The spacing members 6 are then lodged elastically against the socket body 7, which provides relatively problem-free conduction of current between the body 7 and a contact socket structure.

In the embodiment according to FIG. 6, two units, each comprised of a bearing piece 3, a support piece 5, and spacing members 5,6 are joined in the axial direction to form a double unit which can be used as a double socket. In this case, the contact springs 2 which run lengthwise in the direction of the axis A—A through the entire structure are joined to the associated single, common, bearing piece 3 in the central region 8 of the double socket. In the region of the two support pieces 5,5 of the double socket, the free ends of the contact springs 2 rest against the support pieces 5,5.

In the double socket of FIG. 6 and in the simple contact spring socket of FIG. 5 (shown in the left half), the socket body 7 is comprised of a turned cylindrical piece for accommodating the contact socket structure. The socket body 7 of FIG. 5 (shown in the right half thereof) has a centrally projecting rod element 10 at the lower end of said body 7, which lower end is nearer the electrical connecting piece 9. The rod element 10 together with the socket body 7 defines a ring-shaped groove into which the bearing piece end, formed by bearing piece 3, of the contact socket structure can be inserted. The bearing piece 3, with the ends of the contact springs 2 of the contact socket structure, is held in place at the electrical connecting piece 9 by means of a radially inwardly directed deformation 23 of the socket body 7.

FIG. 3 illustrates a variant embodiment of a contact element 1'. Here the contact springs 2', in their middle region 4' between the bearing piece 3' and the support piece 5', are disposed at an angle to the longitudinal direction of the bearing piece and the support piece, in order to improve electrical contact. The associated spacing members 6' are parallel to the contact springs. If this contact element 1' is formed into a cylindrical shape, the configuration of the contact springs 2' corresponds to a set of generatrices of a hyperboloid of revolution. Accordingly, the contact locus is disposed in the middle region 4', with no projecting curvature. Electrical contact with the contact springs is made at the contact locus by the contact plug or pin. With this embodiment, the contact springs 2' may be affixed to not only the bearing piece 3' but the support piece 5' as well (in a single contact socket structure).

FIG. 8 illustrates a connecting plug with a plug body 11 and a contact plug structure formed by bending the contact element 1 into a cylindrical shape. In this case the axis around which the two metal strips 3 and 5 are bent is facing the front side of the contact element 1. Accordingly, the spacing members 6 are disposed on the side facing the plug body 11, namely in such a manner that the members 6 are braced against the body 11, thereby providing relatively problem-free passage of current between the contact element 1 (which has been formed into a contact plug structure) and the electrical connecting piece 9 of the plug body 11.

FIG. 4 illustrates how a contact element 1 according to FIGS. 1 and 2 can be used without forming it into the cylindrical shape of a cylindrical socket or plug but with curving of the contact springs 2, to form a linear contact spring socket 12. For this purpose, a socket body 13 with an electrical connecting piece 9 is provided for use with the contact element 1, which body 13 has a slot-like linear (flat) recess 14. The two metal strips (the bearing piece 3 and the support piece 5), together with the spacing members 6 and the radially curved contact springs 2, are inserted into the recess 14, with the metal strip forming the bearing piece 3 being inserted first, and this inserted assembly, comprising a contact spring structure, is affixed to the body 13. The spacing members 6 abut the lower wall 15 of the wall pair 15, 16 of flat walls of the socket body 13, such that the curved contact springs 4 extend upward into the recess 14. The metal strip which forms the support piece 5 is disposed near the external opening of the recess 14. To protect the free ends of the contact springs from contact with an opposing contact (which is not shown) when the latter is inserted into the recess 14, the metal strip forming the support piece 5 is provided with an extension edge 17 positioned in the plane of the spacing members 6. A holding slot 18 adjoins the flat recess 14. The metal strip which forms the bearing piece 3 is affixed in this slot. Advantageously, a known method of spot welding is employed to affix the extension edge 17 in the flat recess, to the wall 15 of the socket body 13.

The extension edge 17 in FIG. 4 serves as mentioned hereinabove to protect the free ends of the contact springs from contact with an opposing contact. Similar structures, the radially directed guide edge 19 of FIG. 5, 19' of FIG. 6, and the rounded head 24 of FIG. 8, is provided on the socket body 7 and plug body 11. The guide edge 19 of FIG. 5 extends over the support piece 5 to protect it.

While preferred embodiments have been shown and described, the present invention is not limited thereto, but may be otherwise embodied within the scope of the following claims.

I claim:

1. A contact element for an electrical plug connector, comprising:

an assembly including a first metal strip comprising: a bearing piece, said first metal strip extending in a longitudinal direction; a plurality of spacing members connected to said bearing piece and extending in a generally parallel direction to one another, and a second metal strip extending in a generally parallel direction to said first metal strip, said second metal strip comprising a support piece;

in the vicinity of said bearing piece and said support piece, said spacing members being bent away from a common plane of said bearing piece and said support piece and toward a front side of said assembly, such that a middle extent of said spacing members is disposed such that any given two successive spacing members laterally define a flat chamber therebetween; at least one contact spring being disposed in said flat chamber;

a plurality of contact springs disposed in side by side relationship, each of said springs comprising a segment of a contact spring wire one end of which is attached to said bearing piece, and each having, in a middle region thereof, a contact locus adapted for contact with a cooperating contact piece;

said contact springs extending in a direction which is generally perpendicular to said longitudinal direction of said bearing piece and said support piece.

2. A contact element according to claim 1, wherein said two metal strips forming said bearing piece and said support piece, respectively, are bent in an essentially cylindrical shape around an axis perpendicular to a longitudinal direction of said strips and at a predetermined radial distance from them.

3. A contact element according to claim 1, wherein said axis, around which the two said metal strips are bent to form said assembly, is facing a front side of the assembly; and a contact plug structure having a plug body on which said assembly is mounted; said spacing members abutting against said plug body.

4. A contact element according to claim 1, wherein said assembly, comprised of said two metal strips and said spacing members, is stamped out of a single sheet of contact metal.

5. A contact element according to claim 4, wherein said contact springs are radially curved rearwardly, in their middle region between said bearing piece and said support piece, in order to provide good electrical contact.

6. A contact element according to claim 1, wherein in order to provide good electrical contact, said contact springs are disposed at an angular disposition to said longitudinal direction of extent of said bearing piece and said support piece, the angular disposition being in a middle region of said contact springs between said bearing piece and said support piece;

said spacing members also being disposed at an angle so as to be generally parallel to said contact springs.

7. A contact element according to claim 6, wherein said contact springs are fixedly joined to said bearing piece and to said support piece.

8. A contact element according to claim 1, wherein said axis, around which said two metal strips for forming a contact socket structure are bent, is adjacent a rear side of said assembly; further comprising a socket body housing said assembly;

said spacing members being in abutment with said socket body.

9. A contact element according to claim 8, wherein said socket body comprises a turned sleeve for accommodating said contact socket.

10. A contact element according to claim 8, comprising two units, each comprised of a bearing piece, a support piece, and a spacing member, joined in the axial direction to form a double unit which can be used as a double socket; said contact springs, which extend in a direction which is generally parallel to said axial direction through the entire structure comprised of both units, are joined to an associated combined common said bearing piece in a central region of the double socket.

11. A contact element according to claim 8, wherein said socket body has a centrally projecting rod element at an end of said socket body which is directed toward an electrical connecting piece; said rod element together with said socket body defining a ring-shaped groove into which said contact socket structure can be inserted; said contact socket structure being held in place at said electrical connecting piece by a radially inwardly directed deformation of said socket body.

12. A contact element according to claim 8, wherein said socket body comprises a cylindrical sleeve formed from sheet metal, with said contact socket being adapted to be pushed into said sleeve.

13. A contact element according to claim 12, wherein said socket body has a radially directed guide edge which extends in front of a cylindrically formed said support piece, against which piece free ends of said contact springs are in abutting contact.

14. A contact element according to claim 1, further comprising a socket housing for forming a flat contact spring socket, said socket housing having a flat recess into which said two metal strips with said spacing members and radially curved contact springs are inserted, with said metal strip forming said bearing piece being inserted first, said metal strips being affixed to said housing; in assembled condition, said spacing members abutting one of two flat walls of said recess, and said contact springs extending out into said recess, and said metal strip which forms said support piece being disposed near an external opening of said recess.

15. A contact element according to claim 14, wherein, to protect said free ends of contact springs from being contacted by and being damaged by an opposite contact, said metal strip forming said support piece having an extension edge which extends in a plane of a main extent of said spacing members.

16. A contact element according to claim 14, wherein a holding slot adjoins said flat recess;

said metal strip which forms said bearing piece being affixed in said slot.

* * * * *